US010670198B2

(12) United States Patent
Wessel

(10) Patent No.: US 10,670,198 B2
(45) Date of Patent: Jun. 2, 2020

(54) MODULAR POWER MANIFOLD FOR TUBE LIGHTS

(71) Applicant: Elmer A Wessel, Lincoln, NE (US)

(72) Inventor: Elmer A Wessel, Lincoln, NE (US)

( * ) Notice: Subject to any disclaimer, the term of this patent is extended or adjusted under 35 U.S.C. 154(b) by 0 days.

(21) Appl. No.: 16/560,426

(22) Filed: Sep. 4, 2019

(65) Prior Publication Data

US 2019/0390824 A1 Dec. 26, 2019

Related U.S. Application Data

(63) Continuation of application No. 15/948,741, filed on Apr. 9, 2018, now Pat. No. 10,408,389.

(60) Provisional application No. 62/483,076, filed on Apr. 7, 2017.

(51) Int. Cl.

| | |
|---|---|
| ***F21K 9/278*** | (2016.01) |
| ***F21S 4/28*** | (2016.01) |
| ***F21V 15/01*** | (2006.01) |
| ***F21V 15/015*** | (2006.01) |
| ***F21V 17/00*** | (2006.01) |
| ***F21V 19/00*** | (2006.01) |
| ***F21Y 113/00*** | (2016.01) |
| ***F21Y 115/10*** | (2016.01) |
| ***F21K 9/272*** | (2016.01) |
| ***F21K 9/275*** | (2016.01) |
| ***F21K 9/68*** | (2016.01) |
| ***F21V 23/06*** | (2006.01) |
| ***F21Y 103/10*** | (2016.01) |

(52) U.S. Cl.

CPC ..... *F21K 9/278* (2016.08); *F21S 4/28* (2016.01); *F21V 15/013* (2013.01); *F21V 15/015* (2013.01); *F21V 17/002* (2013.01); *F21V 19/009* (2013.01); *F21V 19/0085* (2013.01); *F21K 9/272* (2016.08); *F21K 9/275* (2016.08); *F21K 9/68* (2016.08); *F21V 23/06* (2013.01); *F21Y 2103/10* (2016.08); *F21Y 2113/00* (2013.01); *F21Y 2115/10* (2016.08)

(58) Field of Classification Search

CPC ..... F21K 9/272; F21V 17/002

See application file for complete search history.

(56) References Cited

U.S. PATENT DOCUMENTS

| | | | | |
|---|---|---|---|---|
| 8,454,193 | B2 * | 6/2013 | Simon | F21V 21/005 362/217.17 |
| 9,644,828 | B1 * | 5/2017 | May | F21V 7/00 |
| 2007/0183156 | A1 * | 8/2007 | Shan | B60Q 1/2611 362/277 |
| 2009/0091929 | A1 * | 4/2009 | Faubion | F21V 21/30 362/234 |
| 2014/0022777 | A1 * | 1/2014 | Chen | F21V 19/02 362/220 |
| 2014/0268719 | A1 * | 9/2014 | Wu | F21V 17/002 362/218 |
| 2015/0364886 | A1 * | 12/2015 | Jansen | F21V 25/04 362/221 |

(Continued)

*Primary Examiner* — Alexander K Garlen

(74) *Attorney, Agent, or Firm* — Dobbin IP Law P.C.; Geoffrey E. Dobbin

(57) ABSTRACT

A modular power manifold for a tube light may feature LED strips mounted in a support extrusion. A cover is provided as are two end caps with modular connectors which allow use in multiple settings. A power interface may also be provided to supply auxiliary power to additional loads.

15 Claims, 12 Drawing Sheets

(56) References Cited

U.S. PATENT DOCUMENTS

2016/0290606 A1* 10/2016 Honold ..... F21V 25/04
2017/0314741 A1* 11/2017 Gleeson ..... F21K 9/272

* cited by examiner

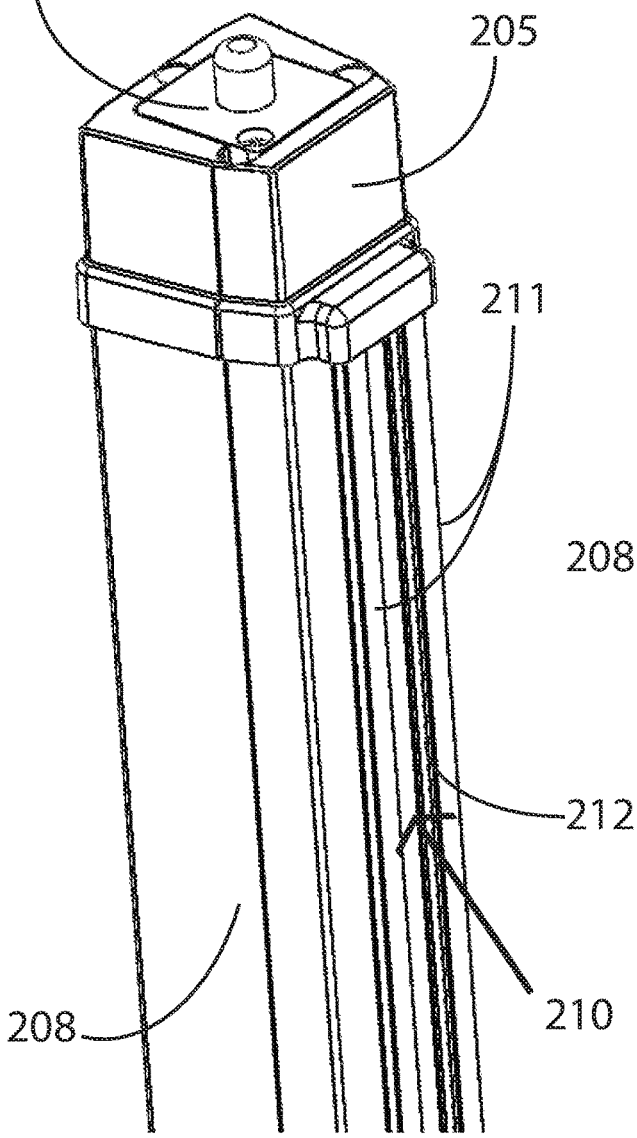
FIG. 3A
FIG. 3B
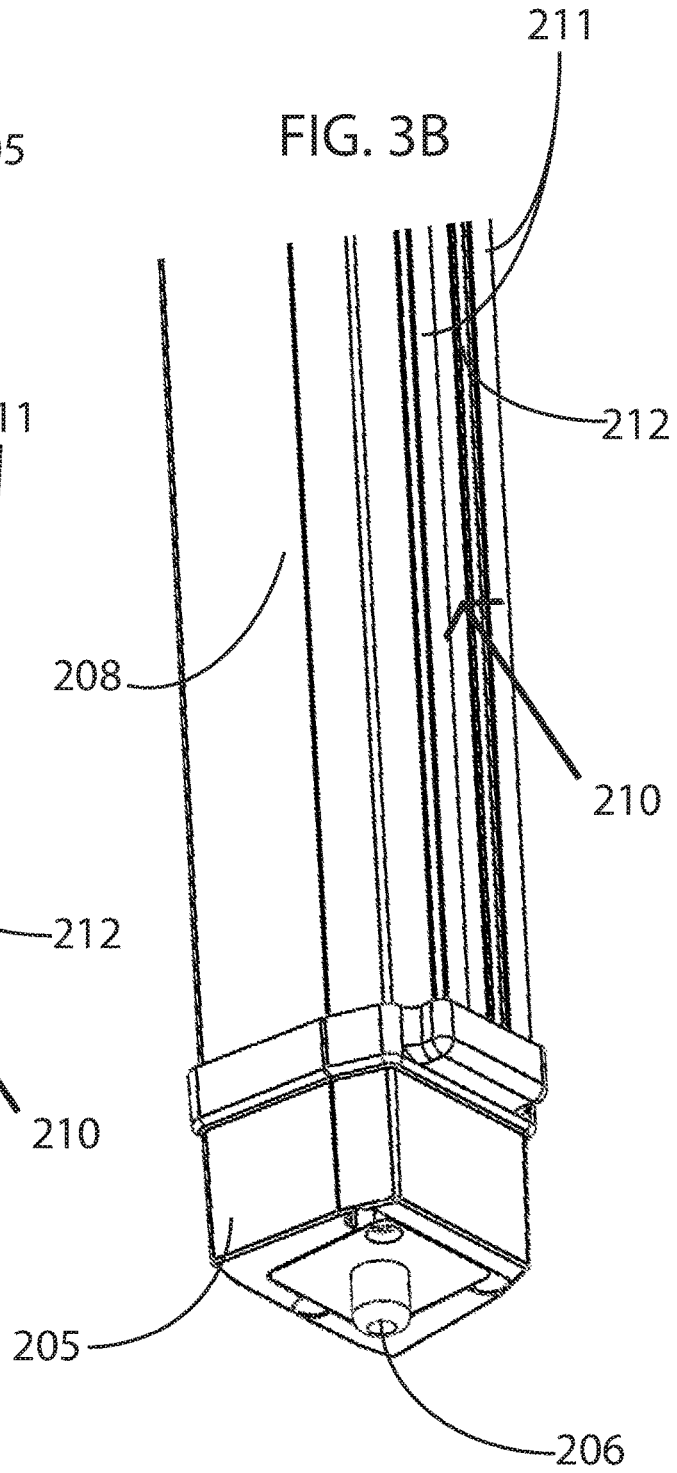

MODULAR POWER MANIFOLD FOR TUBE LIGHTS

CROSS-REFERENCES TO RELATED APPLICATIONS

The present Application claims priority as a continuation of U.S. application Ser. No. 15/948,741, filed Apr. 9, 2018, and issued as U.S. Pat. No. 10,408,389 on Sep. 10, 2019, which is in turn a non-provisional perfection, under the provisions of 35 USC 119(e)(3), of prior filed U.S. Application 62/483,076, filed Apr. 7, 2017, and incorporates the same by reference in its entirety.

FIELD OF THE INVENTION

The present invention relates to the field of lighting and more particularly relates to a replacement manifold which may be fitted into a tube light fitting. One purpose of the manifold may be to provide a replacement light source; but an auxiliary power interface may also be provided and may be provided in lieu of a light source.

BACKGROUND OF THE INVENTION

More and more energy efficient sources of lighting are being utilized in everyday life. However, as these newer sources of lighting are being developed, they are often incompatible with existing infrastructure. This incompatibility then leads to a dilemma—either the newer technology must be forgone, or infrastructure must be replaced to use the newer technology, often at a cost. Many items of newer light technology have strived, therefore, to be as compatible as possible with existing infrastructure, but by no means is this effort complete.

One example of infrastructure incompatibility is the use of fluorescent tube lighting. While residential tubes are standard, commercial lighting infrastructures have at least two different socket structures which must be addressed.

The present invention is a modular powered replacement manifold for use in tube light infrastructure. The replacement manifold may have LED lighting and a basic interface, but then have at least two different interface modules with which to interact with current infrastructure. As such, the same replacement manifold may be manufactured for any tube light socket structure and appropriate attachment modules then used to interface with any of the three, or other developed designs. Alternatively, a separate power interface, which may be a single power strip or may be discrete ports may be provided so that additional powered devices, such as advertisement media, may be utilized with the replacement manifold. When a power interface is provided, it may be provided instead of an actual light supply.

SUMMARY OF THE INVENTION

In view of the foregoing disadvantages inherent in the known types of replacement lights, an improved modular replacement power manifold may provide a base light component which may attach to one of a plurality of sets of attachment components that will interface with known or later developed power infrastructure. A new and improved modular replacement power manifold may also comprise an auxiliary power interface.

A replacement power manifold may have an outer casing surrounding a support extrusion. Mounted within the support extrusion may then be a plurality of LED lights, ideally mounted on a strip, positioned in a manner to provide light to a desired area. Two end caps (one shown in the Figures) provide a power interface to the replacement power manifold. As there are different interfaces within the art, a single generic interface may be provided with the ability to accommodate different modules to the generic interface and allow use in a locale's existing socket hardware. Auxiliary power may be provided in an external strip in the outer casing or through provided sockets. The extrusion and LED lighting may be configured for maximum reflection of light into the environment of the light source.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIGS. 3A and 3B are alternate perspective views of opposite ends of a replacement power manifold.

DETAILED DESCRIPTION OF THE PREFERRED EMBODIMENT

With reference now to the drawings, a preferred embodiment of the replacement power manifold is herein described. It should be noted that the articles "a", "an", and "the", as used in this specification, include plural referents unless the content clearly dictates otherwise.

Figure 1:
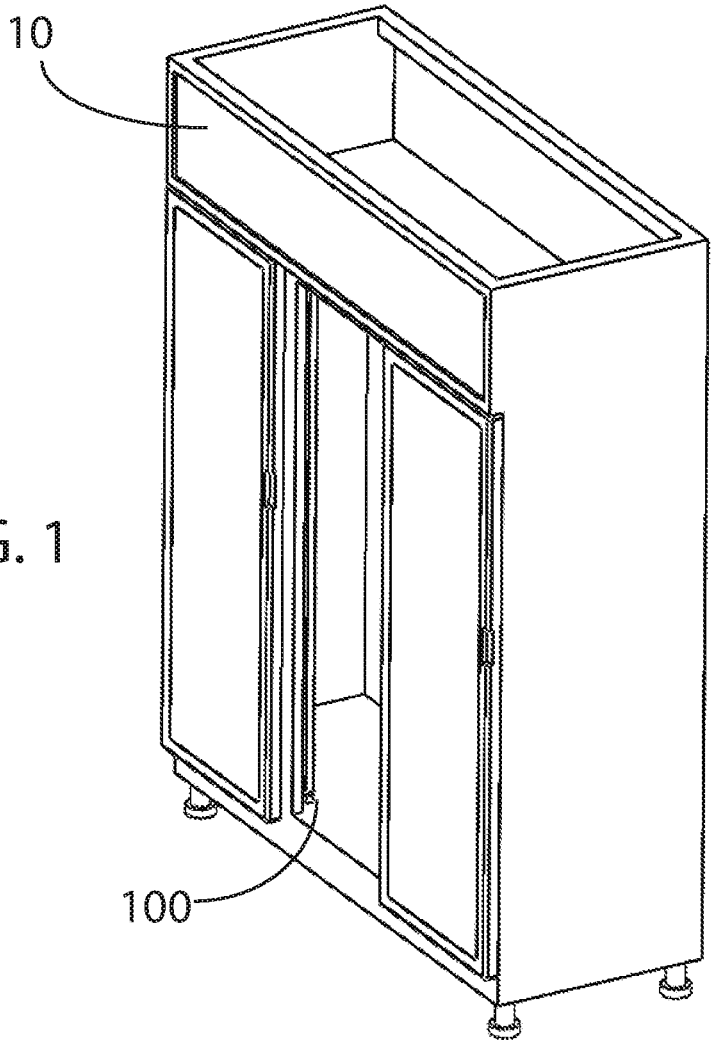
FIG. 1 is a perspective view of a prior art tube light and power infrastructure, such as one found in a retail cooler.
Figure 2:
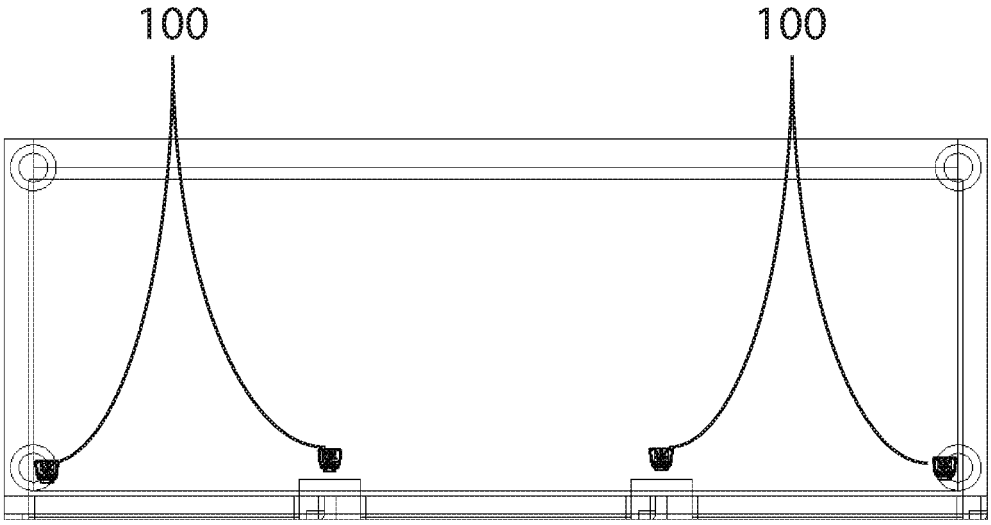
FIG. 2 is a sectional view of the cooler of FIG. 1.
Figure 4:
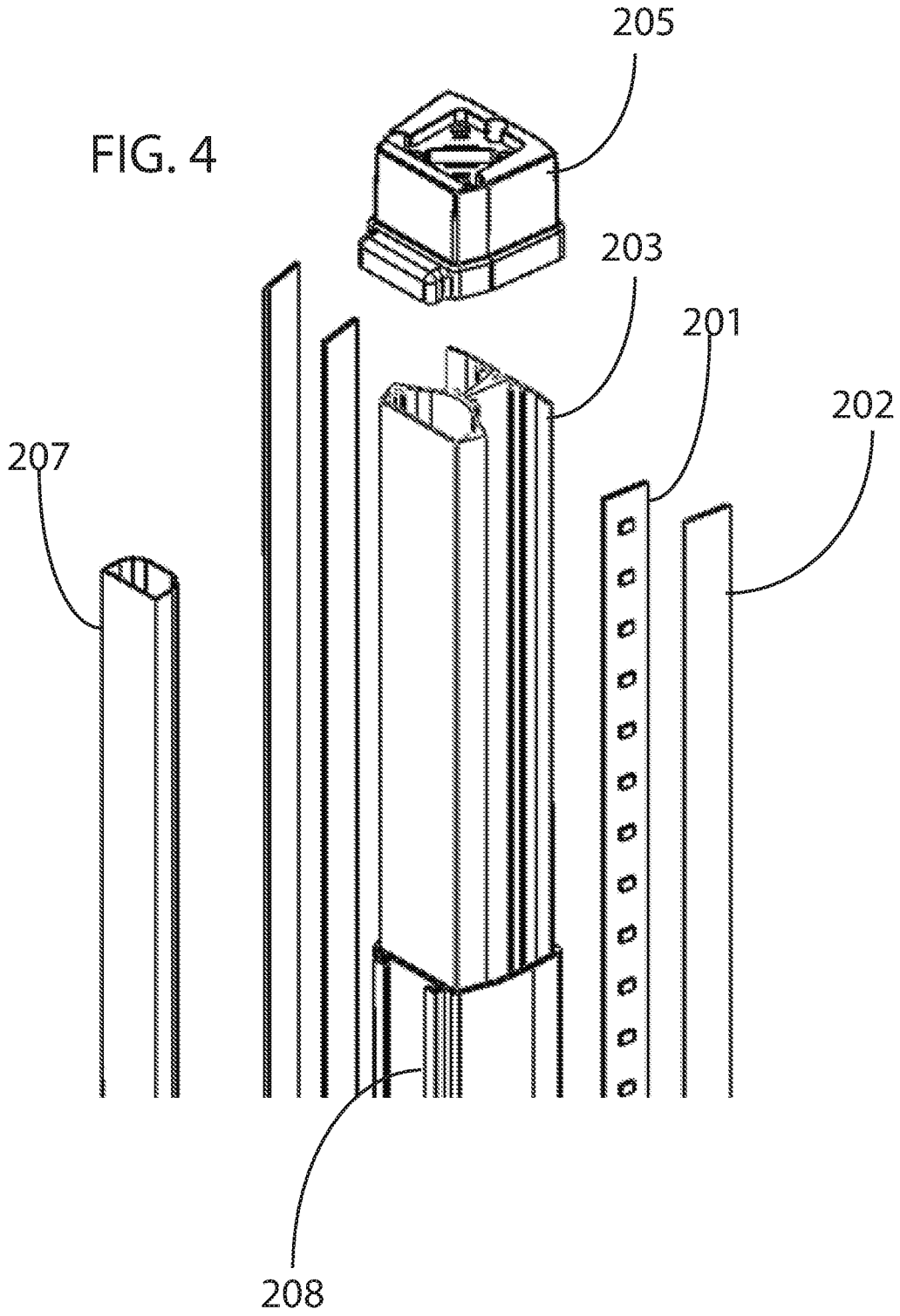
FIG. 4 is a partially exploded view of the replacement power manifold of FIG. 3.

With reference to FIGS. 1 and 2, a prior art tube light 100 rests in provided sockets in its environment. The illustrated environment is a refrigerated display 10, such as is found in grocery and convenience stores. As can be seen in FIG. 2, placement of tube lights 100 is usually found in the corners of the display 10 and behind columns which support doors to the display. Thus, in the illustrated display, there are four tube lights 100, one in each corner and two behind the two dividing columns. The sockets support the tube light 100 and provide power necessary for operation. A replacement power manifold 200 may then fit in the same sockets. For commercial uses, there are currently two standards sockets which are used most often: a single pin (FA8) socket and a high-output (R17D) socket. Residential sockets for tube lights tend to be a dual-pin design. While this Specification is using commercial terminology and scenarios for its description, it is to be readily understood that any similar lighting structure may be replaced with the present invention, including residential fluorescent tubes.

An example of a suitable power manifold is shown in its unmodified form in FIGS. 3-7. This embodiment has a primary purpose of providing light, but other manifolds may be developed with other purposes in mind. Its components may include: one support structure, such as aluminum extrusion 203, to serve as a base, two LED strips 201, two LED covers 202 which fit over the LED strips 201 in the support extrusion 203, two gaskets 204, two endcaps 205, a modular connector 206 for each end cap 205, an electronics package and wiring 207, and a clear external sheath 208. The external sheath 208 features a power interface 210 formed by two ridges 211, each supporting a conductive rail 212 therein.

Figure 5:
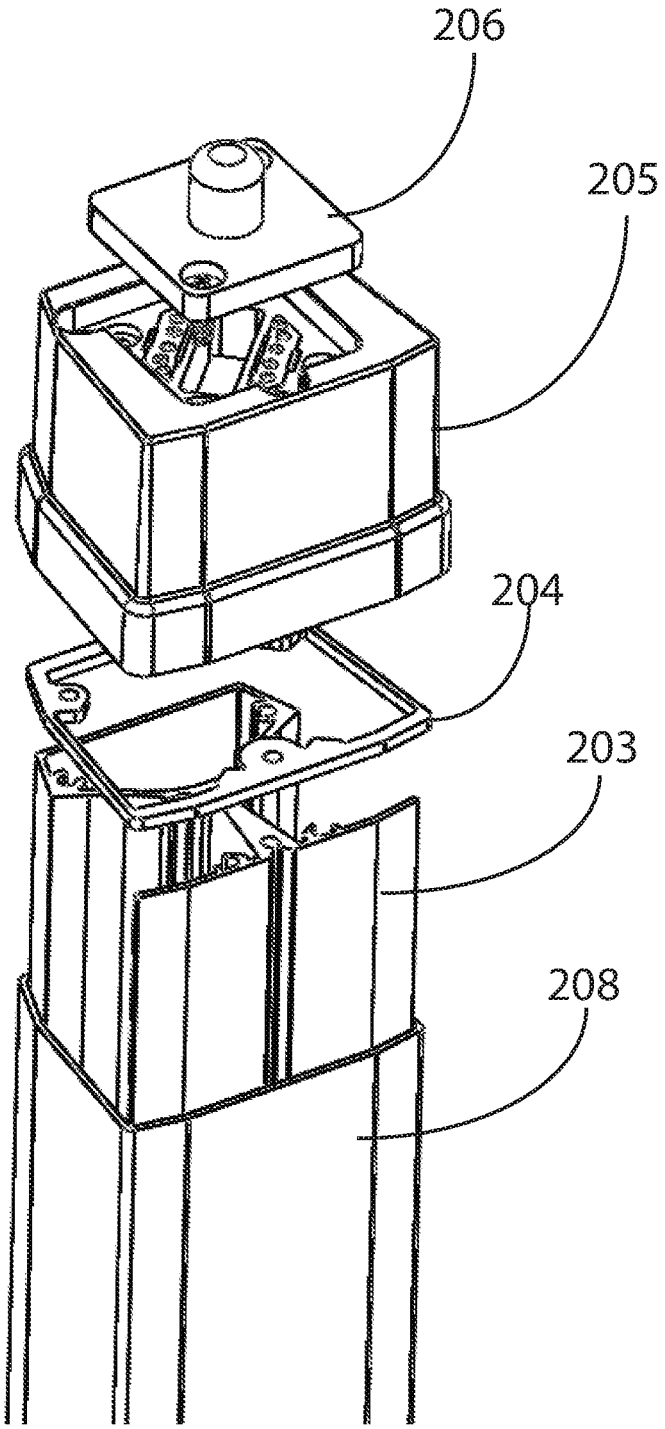
FIG. 5 is a further exploded view of the replacement power manifold of FIG. 3, without the cover.
Figure 6:
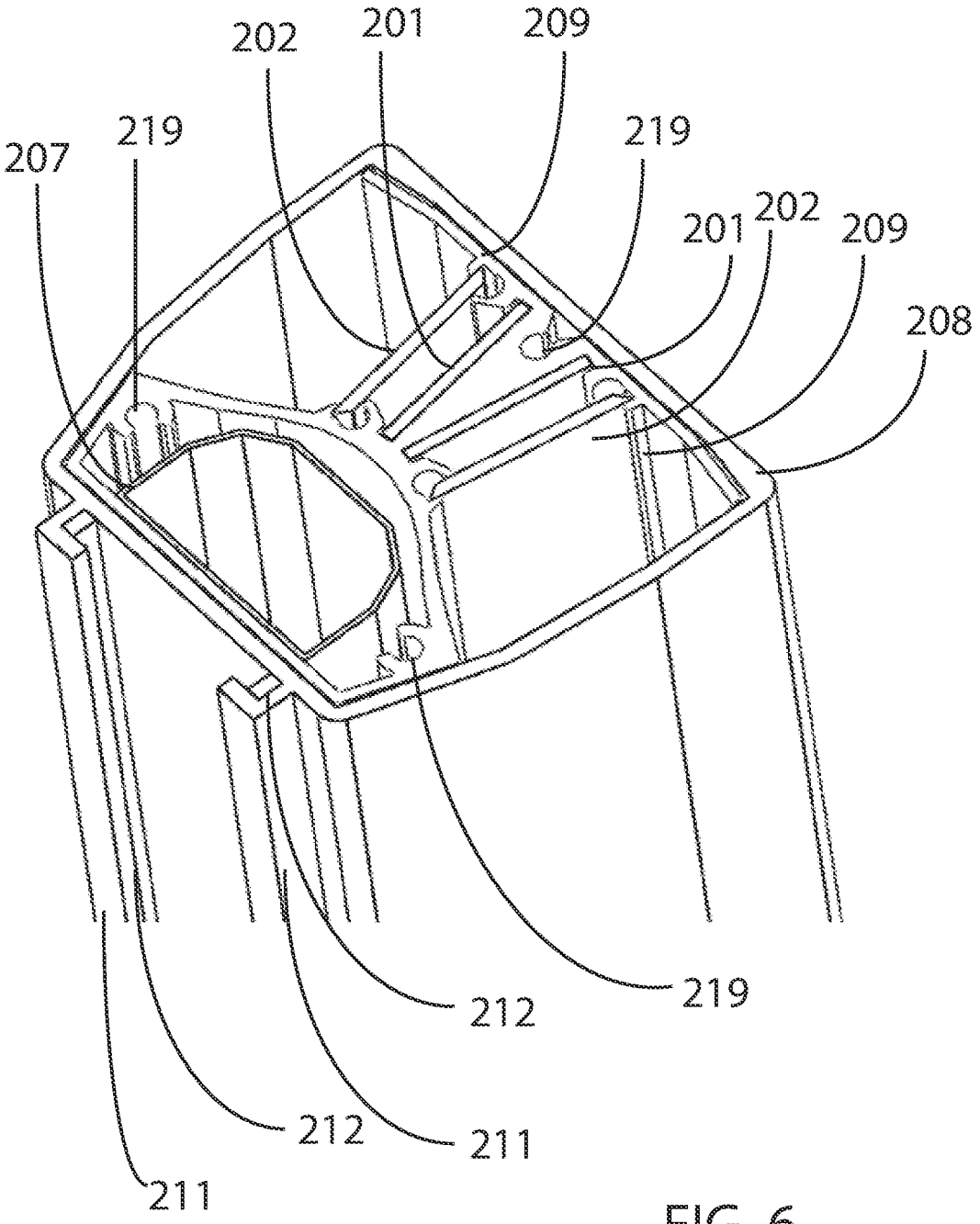
FIG. 6 is a sectional view of the replacement power manifold of FIG. 3.
Figure 7:
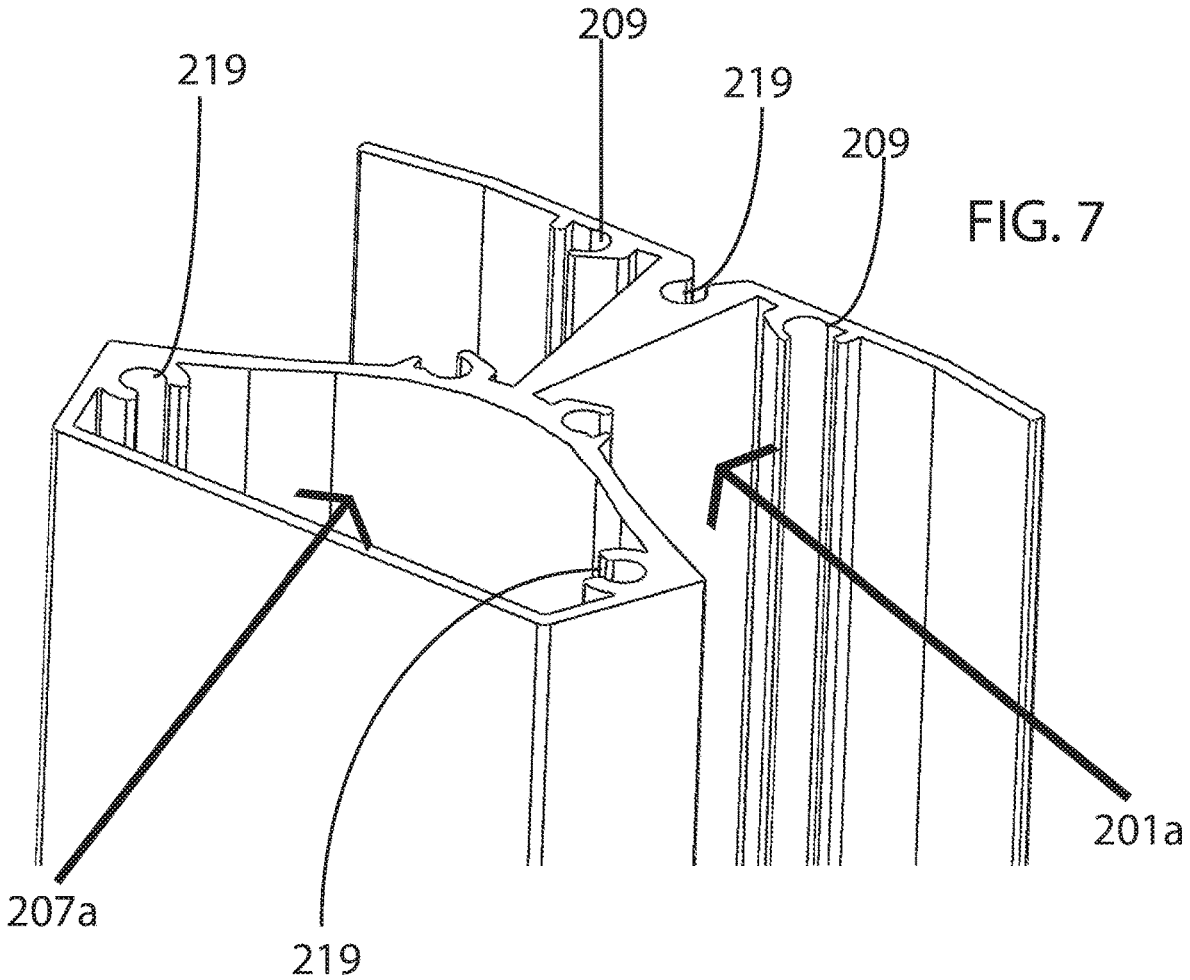
FIG. 7 is a perspective view of an end of the extruded base of the replacement power manifold.

As seen in FIGS. 6 and 7, the support extrusion 203 contains features built-in that contain the LED strips 201, LED covers 202, and electronics package 207. The LEDs slide into corresponding features 201*a* in the extrusion 203 and ideally extend the entire length of the extrusion 203. The shape of the retaining features may be of any design, though the depicted ones will aid in direct heat transmission from the LED strip 201 to the extrusion 203. Because of the support extrusion 203 serving as an ideal heat sink, materials which will efficiently absorb and dissipate heat are preferred for its construction, with aluminum being a preferred choice. Alternatively, an adhesive or dual-sided tape may be used to secure the LED strips 201 to the extrusion 203. The covers 202 are held in place through two clip structures 209 that restrain the two long edges of each cover, thus requiring them to also slide into position. LED location and cover location are determined by the designer with an eye towards where light is desired as the extrusion 203 also further contains reflective geometry to shape the output light from the LED strips 203. The LED covers 202 are provided to mechanically protect the LED strips and to also seal humidity out, such as may be experienced due to temperature differentials in a cooler or in an outside environment, which can lead to condensation. The electronics package 207 is fully contained in its own cavity 207*a* within the extrusion 203. The gaskets 204 (FIG. 5) are positioned on the ends of the aluminum extrusion 203 and form a seal between the endcaps 205 and the extrusion 203 to further isolate the LEDs 203 and electronics package 207 from the outside environment.

Each endcap 205 is affixed to the extrusion 203 through any means known or later developed but may be fixed with up to three bolts (not shown) that thread into corresponding features in the extrusion. In the illustrated embodiment, the extrusion 203 has three receiving geometries 219 for the endcap 205 retention bolts.

Figure 8:
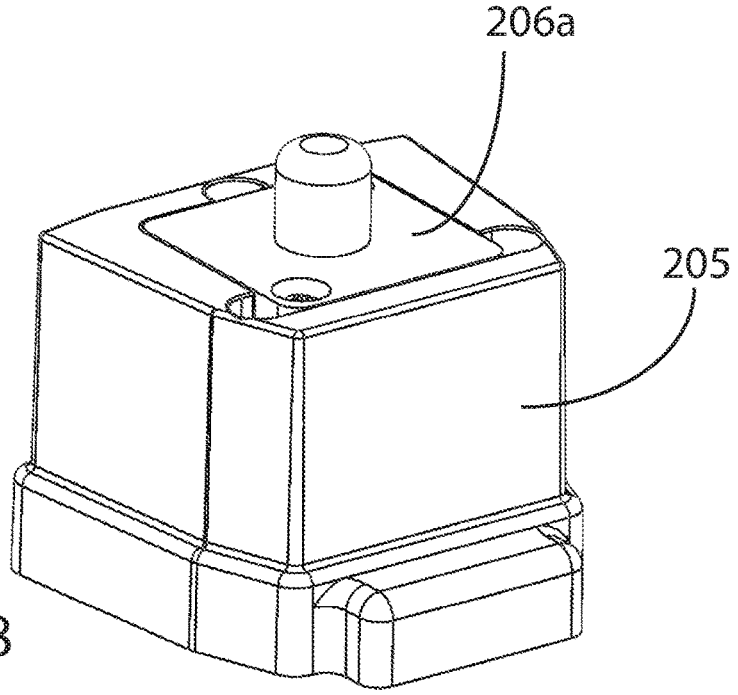
FIG. 8 is a perspective view of one embodiment of an end cap for use with the replacement power manifold of FIG. 2
Figure 9:
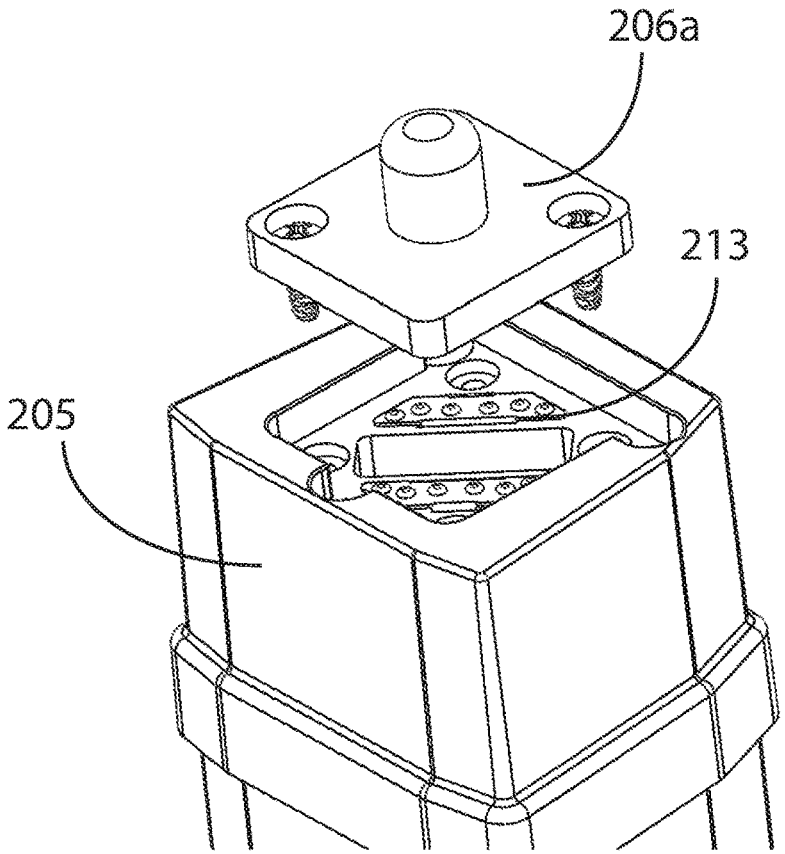
FIG. 9 is an exploded view of the end cap of FIG. 8.
Figure 10:
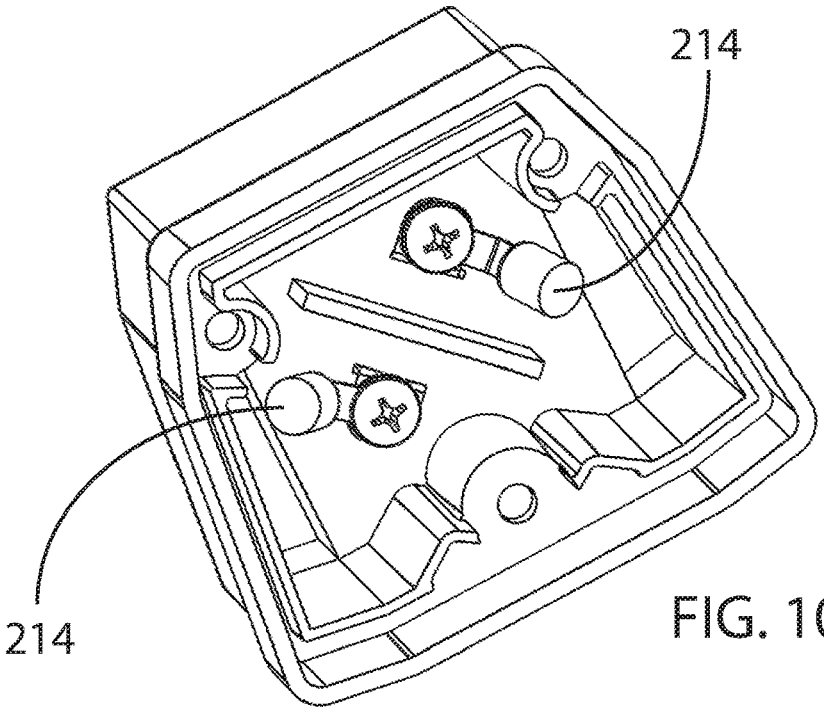
FIG. 10 is a perspective view of the underside of the end cap of FIG. 8.
Figure 11:
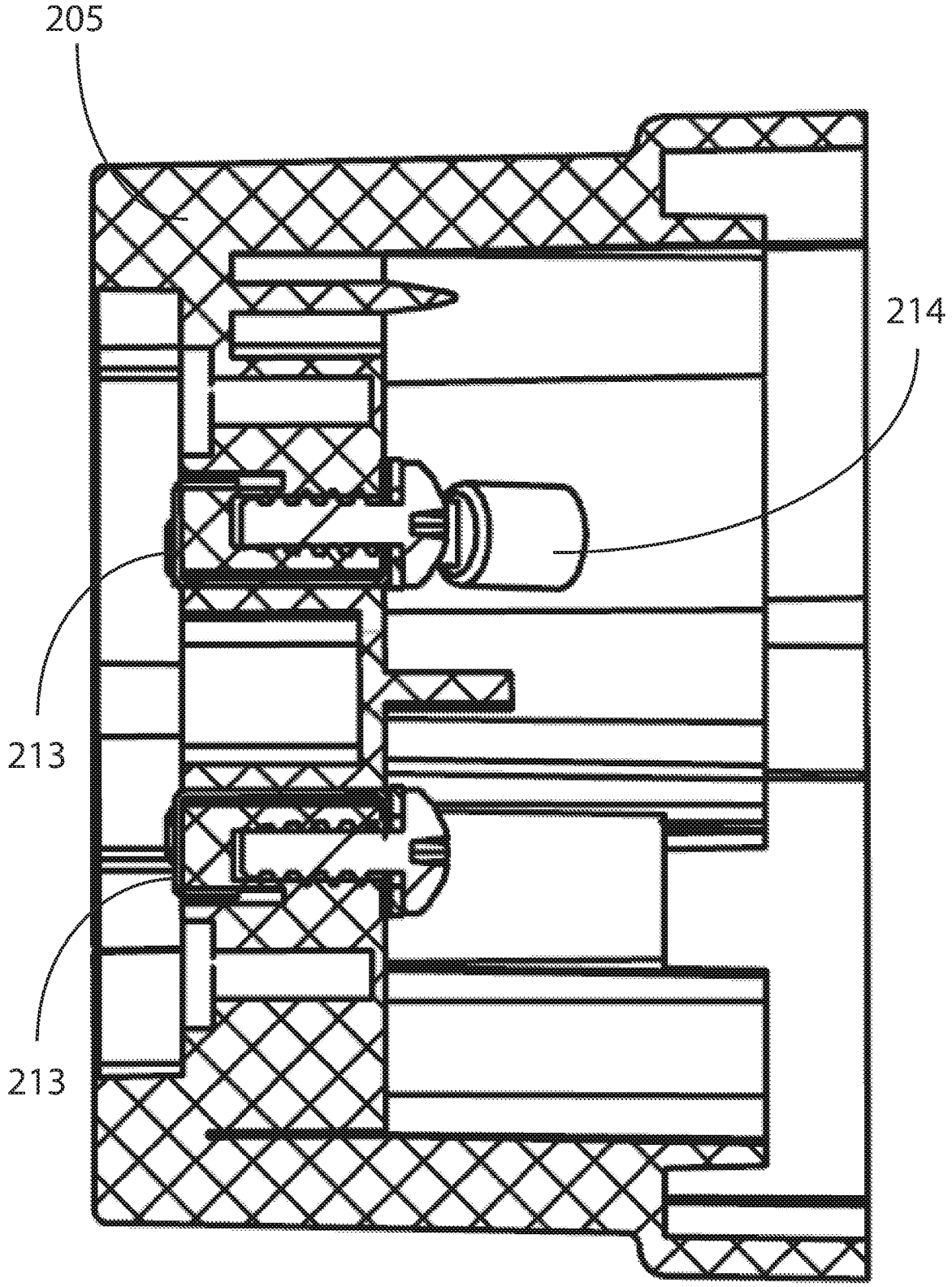
FIG. 11 is a sectional view of the end cap of FIG. 8.
Figure 14:
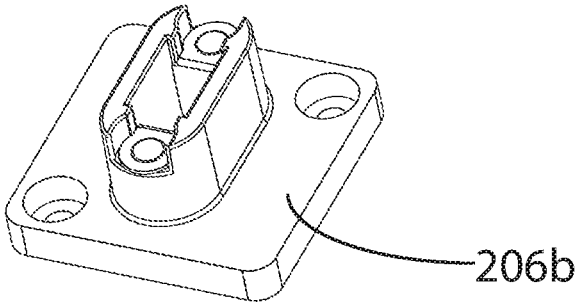
FIG. 14 is a perspective view of an alternate modular connector for use in the end cap shown in FIG. 8.
Figure 15:
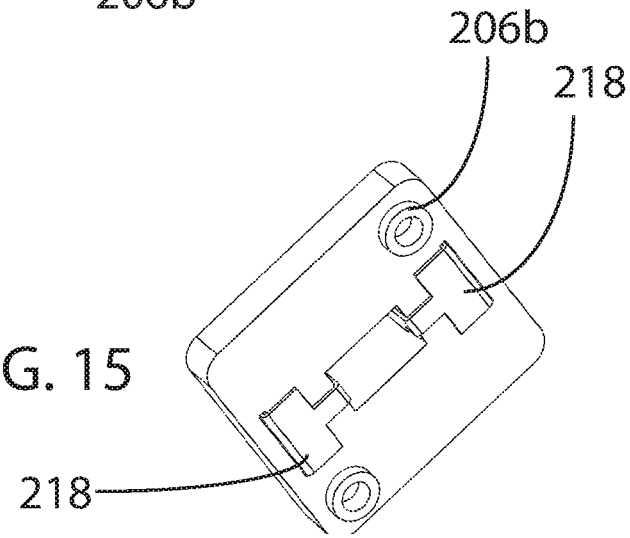
FIG. 15 is an alternate perspective view of the modular connector of FIG. 14.

One modular connector 206*a* is inserted into the endcap 205 (FIG. 8). The bottom surface of the conductor 206 is restrained by two bolts positioned in opposite corners. Four holes are provided for the bolts in the end cap (FIG. 9), as such the modular connector 206*a* may be rotated 90° within the end cap 205. This is of more importance for the high-output connector 206*b* (FIG. 14) and residential dual pin connector as they are naturally oblong and are not as symmetrical as the single pin connector 206*a*. The connector is electrified in the socket and passes electricity through contacts 213 to crimp connectors 214 (or other couplings and connectors) which in turn route power to the control electronics package 207 (FIGS. 10 and 11). It should be readily understood that direct connection of the contacts to the electronics package is possible but is not preferred as it would hinder the ability to replace end caps 205 when necessary.

Figure 12:
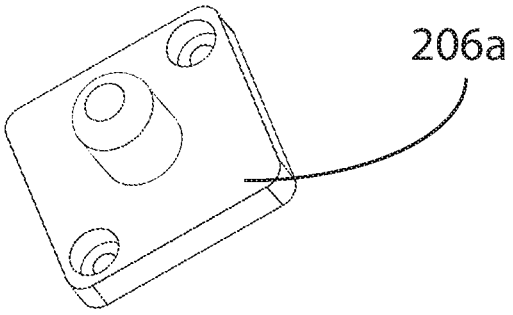
FIG. 12 is a perspective view of the modular connector shown in FIG. 8.
Figure 13:
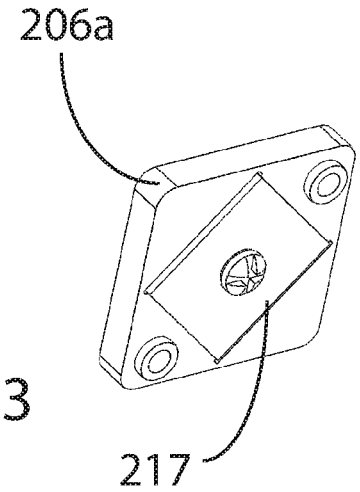
FIG. 13 is an alternate perspective view of the modular connector of FIG. 12.

The connectors shown in FIGS. 12-15 are specially designed for the single pin 206*a* and high output 206*b* commercial sockets. In FIGS. 12 and 13, the single pin connector 206*a* features a single conductive connector on its bottom surface 217, this then makes connection with contacts 213. While two connectors 218 are positioned on the bottom of the high output connector 206*b*.

Figure 16:
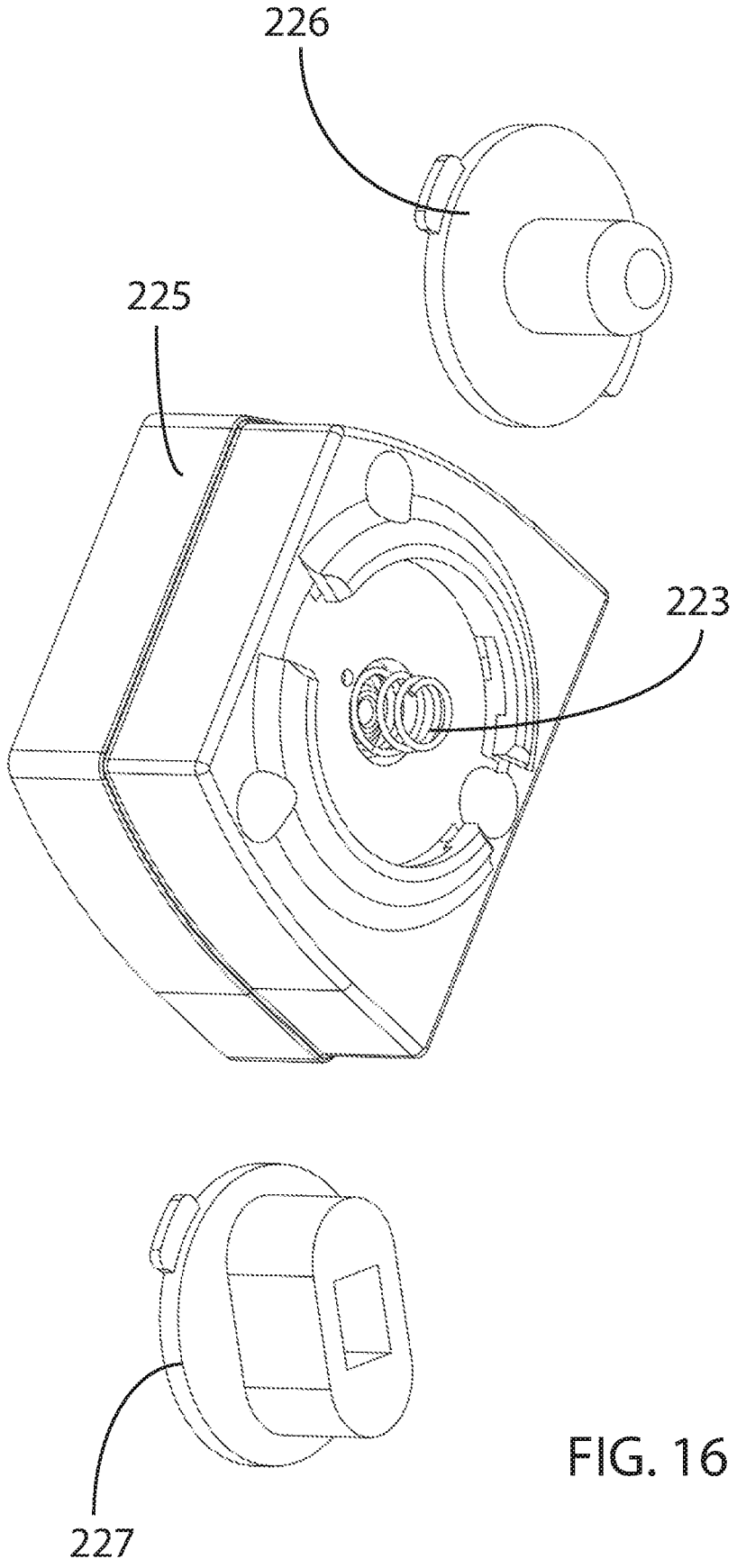
FIG. 16 is a perspective view of an alternate end cap of use with the cooler light of FIG. 2 and two modular connectors for use therewith.

An alternate connector structure may also be provided. As seen in FIG. 16, a simple twist-lock version of the end cap 225 and connectors 226, 227 may be used. In this version, power is transmitted from the appropriate connector 226, 227 to the central spring 223 and distributed to the replacement module's components. As power is distributed to a central spring, only a single bottom conductor is necessary on both types of connectors 226, 227, like connector 217, above. It should be readily understood that many modular interfaces may be conceived for constructing a tube light replacement and the illustrated designs should not be seen as limiting of the invention.

A sheath 208 that is at least partially clear is ideally included that completely encompasses the aluminum extrusion 203 from endcap 205 to endcap 205, as can be partially seen in FIGS. 5 and 6. This plastic sheath 208 further protects the assembly and serves as an additional seal against humidity. This sheath follows the outer profile of the extrusion and bypasses the recesses for the LEDs 201 and their reflectors. The invention may be practiced without sheath 208, relying on LED covers 202 alone to protect the LEDs 201 from the environment. However, lack of a sheath 208 does provide more exposure and eliminates a support for an auxiliary power supply as described below.

Figure 17:
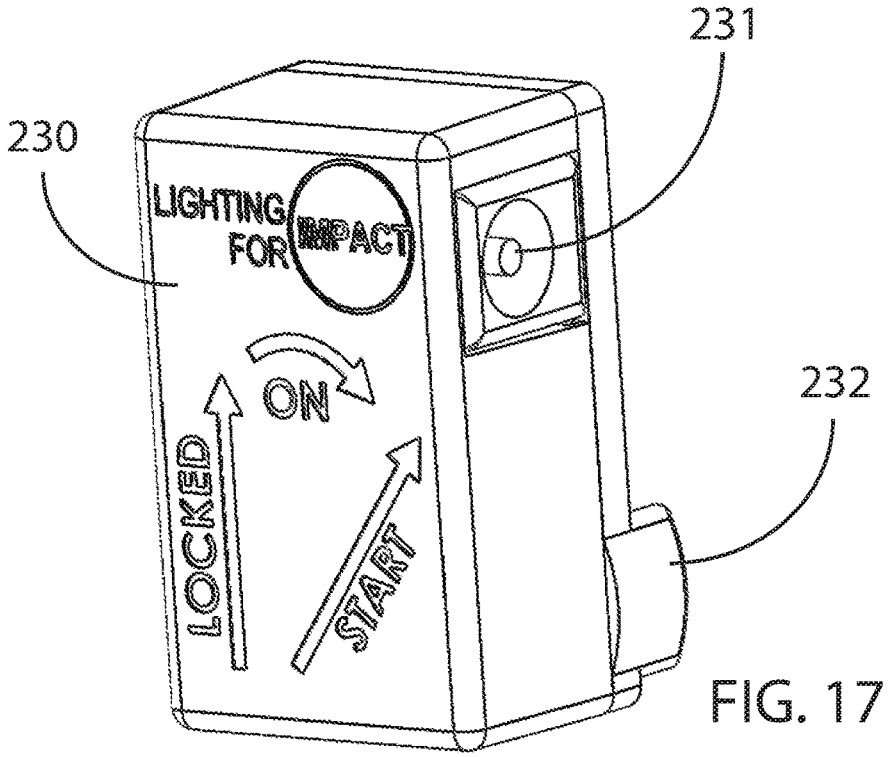
FIG. 17 is a perspective view of a power out interface usable with the power supply provided in one embodiment of the invention.
Figure 18:
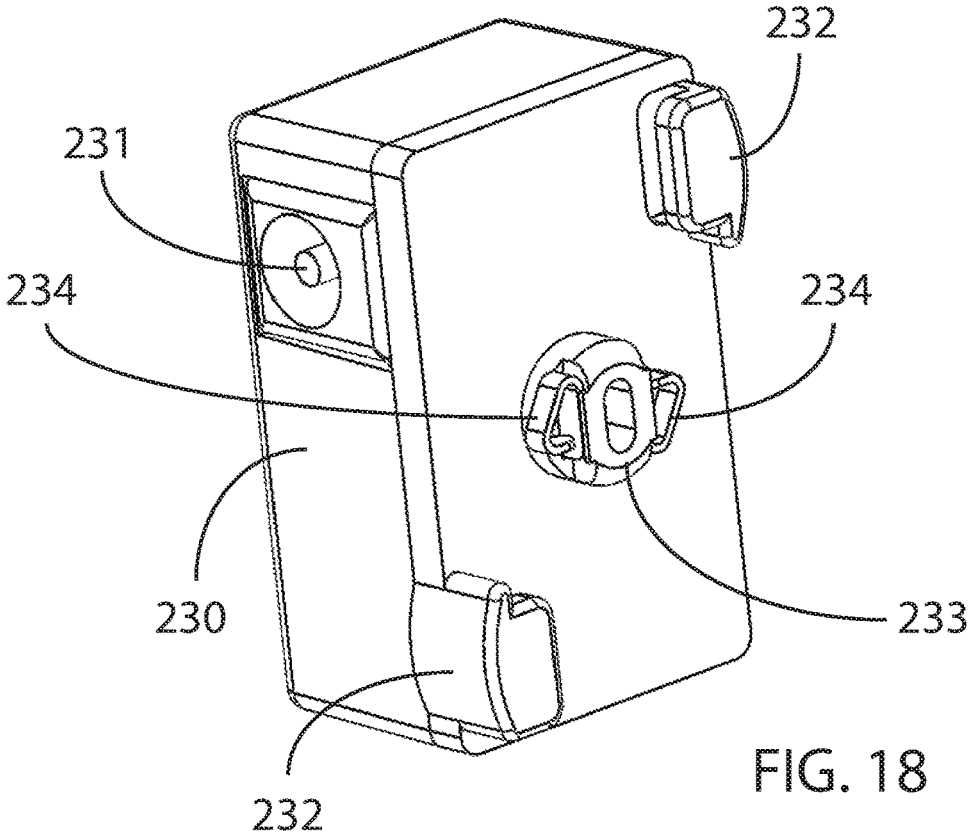
FIG. 18 is an alternate perspective view of the power out interface of FIG. 17.

An auxiliary power supply may be provided on the sheath 208. In one embodiment conductors 212 may run a length of the outside of the sheath 208 while geometry, such as ridges 211, can be easily added to the surface of the sheath 208 that restrains and protects these open conductors 212. One of these conductors would be a ground and the other would provide positive voltage (likely 12V). These two conductors 212 can be separately energized in one embodiment by an interfacing them to spring clips integrated into the endcap 215. Alternately, connections could be provided in the control electronics package 207. A properly sized twist-lock connector 230 may then be positioned within the track formed by the geometry and twisted into contact with the conductors 212, providing a source of auxiliary power. Such a connector is illustrated in FIGS. 17 and 18. The connector 230 features a power out port 231, side supports 232 and a central rear hub 233. Two spring prongs 234 extend from the hub 233 in opposite directions. The connector 230 is positioned such that spring prongs 234 are within the trench of the power interface and the unit twisted so the spring prongs 234 make contact with conductors 212. The interface then supports the connector 230 and provides power for any auxiliary loads. It should also be readily conceived that the auxiliary power supply may also be a module added to the replacement unit.

Figure 19:
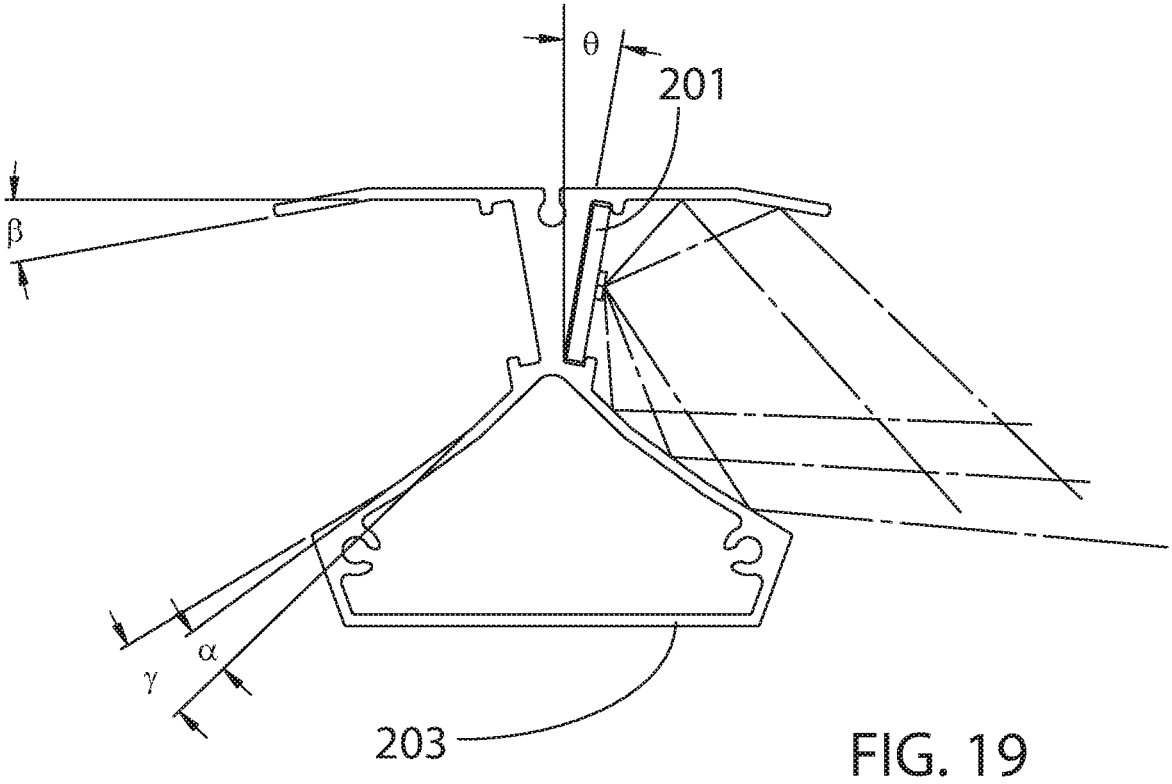
FIG. 19 is a top plan view of the extrusion support of the power manifold of FIGS. 3A and 3B, showing light reflection by the extrusion support.

As any given LED strip 201 will generally emit light at about a 180° angle in a given plane, usefully reflecting emitted light into the environment is a helpful way to reduce the number of LEDs required to light said environment. The support extrusion 203 (FIG. 19) may easily be made of a mirrored or other reflective medium and its shape generated to maximize light emitted from LEDs. In this manner, most of the light emitted from the LED strips may be reflected or naturally emitted in one general direction (generally rearwards, into the environment). Aluminum may serve as an ideal material not only in heat dissipation but also light reflectivity. In the preferred embodiment, this involves mounting the LED strip 201 angled slightly rearwards θ and then fashioning the sides of the support extrusion 203 to have other angled surfaces α, β, γ, to maximally direct the light. For the illustrated embodiment, all these angles may be equal to or less than 15° with one surface having a slight bend from a shallower angle, α to a larger angle γ. It should be noted, however, that each of these angles, and the overall shape and design of the support extrusion 203 will be dependent upon desired effects, size, material, and other factors. As such this example in FIG. 19 should not be seen limiting in scope.

Although the present invention has been described with reference to preferred embodiments, numerous modifications and variations can be made and still the result will come within the scope of the invention. No limitation with respect to the specific embodiments disclosed herein is intended or should be inferred. One particular variation would be to provide a tube light replacement with just the power interface and no lighting. Alternative auxiliary power supplies could involve simple barrel connectors or some other power port in the end caps, though this would limit the utility of being able to place a connector at any location on the strip. Power ports may also be supplied in an elongate body or ends of a replacement bar with LED lights attached thereto. The control electronics 207 may be eliminated in a 120 V application, if the LED strip 201 and/or auxiliary power supply require 120 V, in this case, the loads could be wired directly to the power conductors in the end caps.

What is claimed is:

1. A modular power manifold for a given mounting structure, the modular power manifold comprising:

a support structure having a length and two ends;

at least one light source mounted upon the support structure;

a sleeve positioned over the light source and support structure, isolating them from an environment;

two end caps, one on each end; capable of fitting over the sleeve to further isolate the support structure and light source from the environment, at least one end cap further comprising:

an end cap body with a generally polygonal cavity on a top surface;

at least one power coupling internal of the end cap; and at least one power contact operably connected to the power coupling and located in the generally polygonal cavity; and at least one modular electrical connector, secured to the end cap by at least one bolt and in operable connection with the power contact, such that power may be drawn from the mounting structure, passed though the modular electrical connector, and into the power manifold, the modular electrical connector being selected to be adaptable to different kinds of mounting structures.

2. The modular power manifold of claim 1, the modular electrical connector being selected from a set of modular electrical connectors suitable for use in FA8 and R17D sockets.

3. The modular power manifold of claim 1, the at least one power contact and modular electrical connector being configured to orient the modular electrical connector in at least two positions, allowing the modular electrical connector to have at least two different orientations in relation to the modular power manifold when installed.

4. The modular power manifold of claim 1, further comprising at least one cover positioned over the light source to separate the light source from an environment defined by the sleeve.

5. The modular power manifold of claim 1, further comprising two light strips.

6. The modular power manifold of claim 1, the support structure being a support extrusion.

7. The modular power manifold of claim 6, the support structure being comprised of a reflective material to direct most of the light from the light source in one general direction.

8. A modular power manifold for a given mounting structure, the modular power manifold comprising:

a support structure having a length and two ends;

at least one light source mounted upon the support structure;

a sleeve positioned over the light source and support structure, isolating them from an environment;

two end caps, one on each end; capable of fitting over the sleeve to further isolate the support structure and light source from the environment, at least one end cap further comprising:

an end cap body with a generally polygonal cavity on a top surface;

at least one power coupling internal of the end cap; and at least one power contact operably connected to the power coupling and located in the generally polygonal cavity; and at least one modular electrical connector, insertable into the polygonal cavity while having operable connection with the power contact, such that power may be drawn from the mounting structure, passed though the modular electrical connector, and into the power manifold, the modular electrical connector being selected to be adaptable to different kinds of mounting structures.

9. The modular power manifold, the at least one power contact being two power contacts, each extending proximate a center of one side of the polygonal cavity towards a center of an adjacent side of the polygonal cavity.

10. The modular power manifold of claim 9, the end cap having a rectangular polygonal cavity and further comprising four anchor holes, one in each corner of the polygonal cavity and the modular electrical connector comprising two diametrically opposed mounting holes which will be in line with two of the anchor holes when the modular electrical connector is positioned within the polygonal cavity; wherein the modular electrical connector may be secured in the polygonal cavity by two bolts and may be rotated approximately 90° relative to the end cap and still fit and function.

11. The modular power manifold of claim 8, the modular electrical connector being selected from a set of modular electrical connectors suitable for use in FA8 and R17D sockets.

12. The modular power manifold of claim 8, further comprising at least one cover positioned over the light source to separate the light source from an environment defined by the sleeve.

13. The modular power manifold of claim 8, further comprising two light strips.

14. The modular power manifold of claim 8, the support structure being a support extrusion.

15. The modular power manifold of claim 14, the support structure being comprised of a reflective material to direct most of the light from the light source in one general direction.

* * * * *